US008749601B2

(12) United States Patent
Tsuchihashi et al.

(10) Patent No.: US 8,749,601 B2
(45) Date of Patent: Jun. 10, 2014

(54) DEVICE DETECTING CURL OF SHEET AND IMAGE ERASING DEVICE

(71) Applicants: Kabushiki Kaisha Toshiba, Tokyo (JP); Toshiba Tec Kabushiki Kaisha, Tokyo (JP)

(72) Inventors: Hiroyuki Tsuchihashi, Tokyo (JP); Takahiro Kawaguchi, Tokyo (JP); Isao Yahata, Tokyo (JP); Hiroyuki Taguchi, Tokyo (JP); Ken Iguchi, Tokyo (JP); Hiroyuki Taki, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/973,635

(22) Filed: Aug. 22, 2013

(65) Prior Publication Data

US 2014/0015913 A1 Jan. 16, 2014

Related U.S. Application Data

(62) Division of application No. 13/045,418, filed on Mar. 10, 2011, now Pat. No. 8,542,260.

(60) Provisional application No. 61/314,115, filed on Mar. 15, 2010, provisional application No. 61/314,119, filed on Mar. 15, 2010, provisional application No. 61/314,120, filed on Mar. 15, 2010.

(51) Int. Cl.
*B41J 15/10* (2006.01)
*B41J 11/00* (2006.01)

(52) U.S. Cl.
USPC ..... 347/179; 347/218

(58) Field of Classification Search
USPC ..... 347/171, 179, 218, 215, 222
See application file for complete search history.

(56) References Cited

U.S. PATENT DOCUMENTS

| | | | | |
|---|---|---|---|---|
| 4,860,029 | A * | 8/1989 | Iseda | 347/218 |
| 5,896,156 | A | 4/1999 | Suzuki et al. | |
| 5,921,687 | A * | 7/1999 | Koike et al. | 347/215 |
| 6,232,992 | B1 | 5/2001 | Rombult et al. | |
| 7,102,658 | B2 | 9/2006 | Sanbongi et al. | |
| 7,167,192 | B2 * | 1/2007 | Ohta | 347/218 |

FOREIGN PATENT DOCUMENTS

| | | |
|---|---|---|
| JP | H0470842 | 3/1992 |
| JP | H06-305609 | 11/1994 |
| JP | H08-175731 | 7/1996 |
| JP | 2006-264921 | 10/2006 |

OTHER PUBLICATIONS

English Translation of Office Action filed Jan. 7, 2014 in corresponding Japanese Patent Application No. 2011-055210.

* cited by examiner

*Primary Examiner* — Kristal Feggins
(74) *Attorney, Agent, or Firm* — Patterson & Sheridan, L.L.P.

(57) ABSTRACT

There is provided a device detecting curling of a sheet, the device including a first guide member carrying the sheet; a second guide member including a carriage path that is broader than the carriage path of the first guide member and accepting the curling of the sheet; and sensors with detection ranges into which a portion of the curling of the sheet enters, in the carriage path of the second guide member.

12 Claims, 10 Drawing Sheets

FIG.5

| OUTPUT OF SENSOR 33a | OUTPUT OF SENSOR 33b | OUTPUT OF SENSOR 33c | OUTPUT OF SENSOR 33d | DETERMINATION |
|---|---|---|---|---|
| OFF | OFF | OFF | OFF | NO CURL |
| ON | OFF | OFF | OFF | CURLED UPWARDLY (SMALL) |
| ON | ON | OFF | OFF | CURLED UPWARDLY (LARGE) |
| OFF | OFF | ON | OFF | CURLED DOWNWARDLY (SMALL) |
| OFF | OFF | ON | ON | CURLED DOWNWARDLY (LARGE) |

DEVICE DETECTING CURL OF SHEET AND IMAGE ERASING DEVICE

CROSS-REFERENCE TO RELATED APPLICATION(S)

This application is based upon and claims the benefit of priority from U.S. patent application Ser. No. 13/045,418, filed on Mar. 10, 2011; which claims the benefit of priority from U.S. provisional application 61/314,115, filed on Mar. 15, 2010; U.S. provisional application 61/314,119, filed on Mar. 15, 2010; and U.S. provisional application 61/314,120, filed on Mar. 15, 2010; the entire contents of which are each incorporated herein by reference.

FIELD

Embodiments described herein relates generally to a device detecting curling of a sheet and to an image erasing device.

BACKGROUND

There is a device performing a specific process on a sheet while carrying the sheet. When the sheet is curled, there is concern that a jam may occur during carriage of the sheet.

BRIEF DESCRIPTION OF THE DRAWINGS

FIG. 5 is a view showing relationship between outputs of sensors and determination results of curled state in the first embodiment.

DETAILED DESCRIPTION

According to the embodiment, the device detecting curl of a sheet includes a first guide member carrying the sheet; a second guide member including a carriage path that is broader than the carriage path of the first guide member and accepting curling of the sheet; and sensors with detection ranges into which a portion of the curling of the sheet enters, in the carriage path of the second guide member.

First Embodiment

Figure 1:
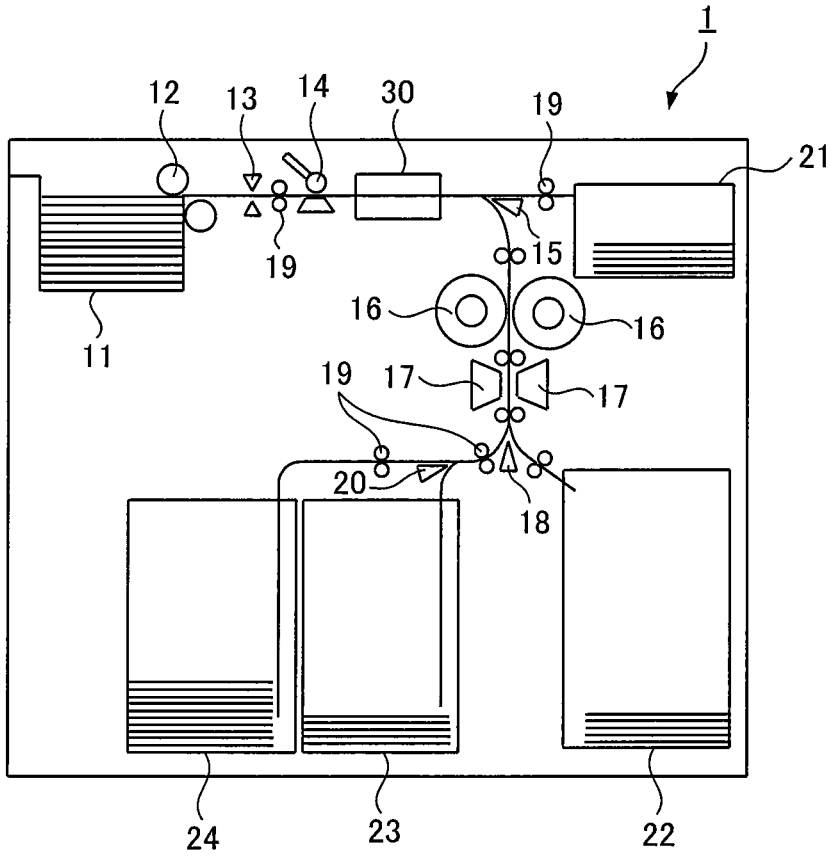
FIG. 1 is a view showing an internal configuration of an image erasing device as a first embodiment.

FIG. 1 is a view showing an internal configuration of an image erasing device 1.

The image erasing device 1 erases images formed on sheets and sorts the sheets into reusable sheets and non-reusable sheets. When an image is formed on the sheet by using a developer which is erased by heat, it is possible to erase the image formed on the sheet by heating the sheet.

A sheet feeding tray 11 is loaded with sheets to be subjected to image erasing. A pickup roller 12 takes sheets out of the sheet feeding tray 11, and supplies the sheets to the carriage path. A plurality of carriage rollers 19 is disposed along the carriage path.

A detection unit 13 detects whether a plurality of sheets are stacked. The detection unit 13 includes an ultrasonic generator and an ultrasonic detector disposed so as to interpose the carriage path therebetween. The ultrasonic generator irradiates ultrasonic waves to the sheet. The ultrasonic detector receives the ultrasonic waves passing through the sheet and outputs electric signals according to the ultrasonic waves.

Figure 2:
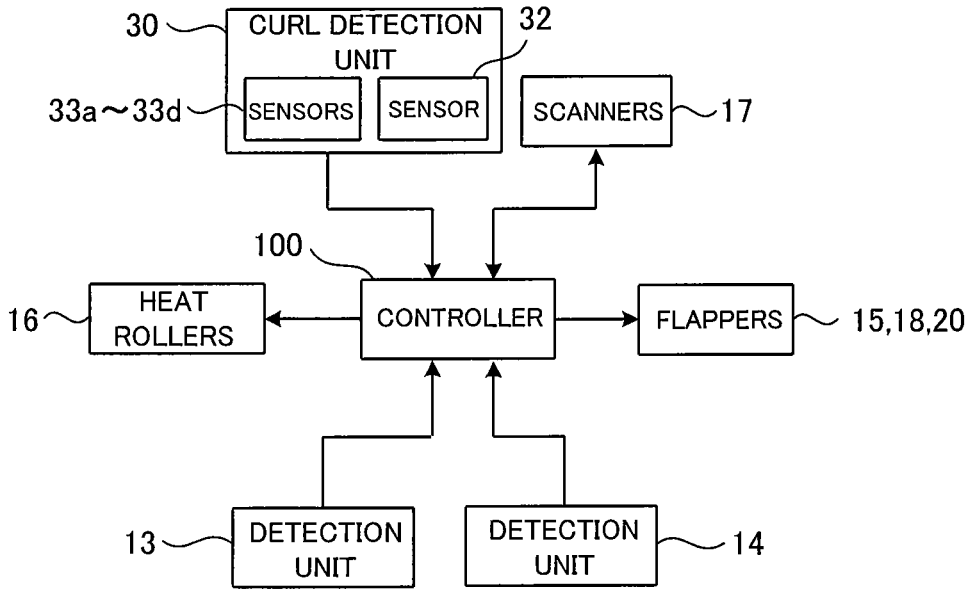
FIG. 2 is a view showing a circuit configuration of the image erasing device according to the first embodiment.

As shown in FIG. 2, the output signals of the detection unit 13 are input into a controller 100 of the image erasing device 1, and the controller 100 determines whether a plurality of sheets are stacked. The controller 100 controls the operation of the image erasing device 1.

A detection unit 14 detects the thickness of a sheet. The detection unit 14 includes an arm displaced in the vertical direction when a sheet passes, a permanent magnet provided to the arm, and a magnetic sensor detecting the magnetism of the permanent magnet. The detection unit 14 (magnetic sensor) outputs electric signals according to the thickness of the sheet. As shown in FIG. 2, based on the output of the detection unit 14, the controller 100 determines the thickness of the sheet.

A curl detection unit 30 detects the curled state of the sheet, and outputs the detection results to the controller 100. The curl state includes the curl direction and the curl amount. The curl amount is the amount of deformation of the sheet accompanying the curl.

A flapper 15 switches the carriage path guiding the sheet from the curl detection unit 30 to a collection box 21 to the carriage path guiding the sheet to heat rollers 16. When the sheet is carried to the collection box 21, the sheet from the sheet feeding tray 11 reaches the collection box 21 without being bent.

The controller 100 controls driving of the flapper 15. A sheet that cannot be carried to the heat rollers 16 is carried to the collection box 21. Examples of cases where the sheet cannot be carried to the heat rollers 16 include a case where a plurality of sheets is carried while being stacked, a case where the thickness of the sheet does not fall within a predetermined range, and a case where the curl detection unit 30 detects that the sheet is curled. An example of the case where a plurality of sheets is stacked is a case where a plurality of sheets is still stapled.

Since the carriage path from the sheet feeding tray 11 to the collection box 21 is disposed along a straight line, a plurality of sheets stacked up each other and the sheet with a thickness outside the prescribed thickness can smoothly move to the collection box 21. In the carriage path from the sheet feeding tray 11 to the collection box 21, the occurrence of a paper jam can be inhibited.

Two heat rollers 16 are disposed in positions interposing the carriage path of the sheet therebetween. The heat rollers 16 heat the sheet to the color erasing temperature. The color erasing temperature is a temperature at which the color of the developer attached to the sheet can be erased. By erasing the color of the developer, it is possible to erase the image formed on the sheet. The controller 100 controls the driving of the heat rollers 16.

In the embodiment, two heat rollers 16 are disposed in positions interposing the carriage path of the sheet therebetween. However, as long as the sheet can be heated, the configuration can be modified. As a heat source, for example, a thermal head, an infrared lamp, and a halogen lamp can be used, in addition to the heat rollers 16. The heat source can provide heat to the sheet while contacting the sheet; also, the heat source can provide heat to the sheet in a position distant from the sheet. It is possible to dispose the heat roller 16 at only one side of the carriage path. At the other side of the carriage path, a roller that does not include a heater can be disposed.

Two scanners 17 are disposed at positions interposing the carriage path of the sheet therebetween, and read the sheet carried from the heat rollers 16. The results of the reading of the scanners 17 are output to the controller 100. On the basis of the results of the reading of the scanners 17, the controller 100 determines whether the image has been erased.

A flapper 18 switches the carriage path guiding the sheet to a box 22 to the carriage path guiding the sheet to boxes 23 and 24. The controller 100 controls the driving of the flapper 18.

When the image on the sheet is not erased, the controller 100 drives the flapper 18 and guides the sheet from the scanners 17 to the box 22. When the image on the sheet is erased, the controller 100 drives the flapper 18 and guides the sheet from the scanners 17 to the boxes 23 and 24.

A flapper 20 switches the carriage path guiding the sheet to the box 23 to the carriage path guiding the sheet to a box 24. The controller 100 controls the driving of the flapper 20.

The boxes 23 and 24 can contain sheets having different sizes with each other. The controller 100 can control the driving of the flapper 20 according to the size of the sheet.

Also, the controller 100 can drive the flapper 20 according to the result of the reading of the two scanners 17. When the image on one side of the sheet is not erased while the image on the other side of the sheet is erased, the box 23 can contain the sheet. When the images on both sides of the sheet are erased, the box 24 can contain the sheet. When the images remain on both sides of the sheet, the box 22 can contain the sheet.

Figure 3:
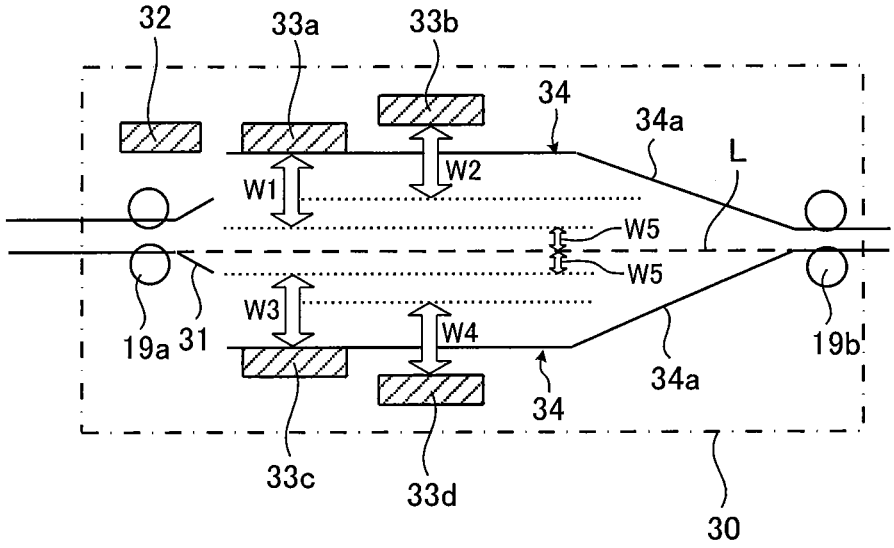
FIG. 3 is a lateral view of a curl detection unit according to the first embodiment.
Figure 4:
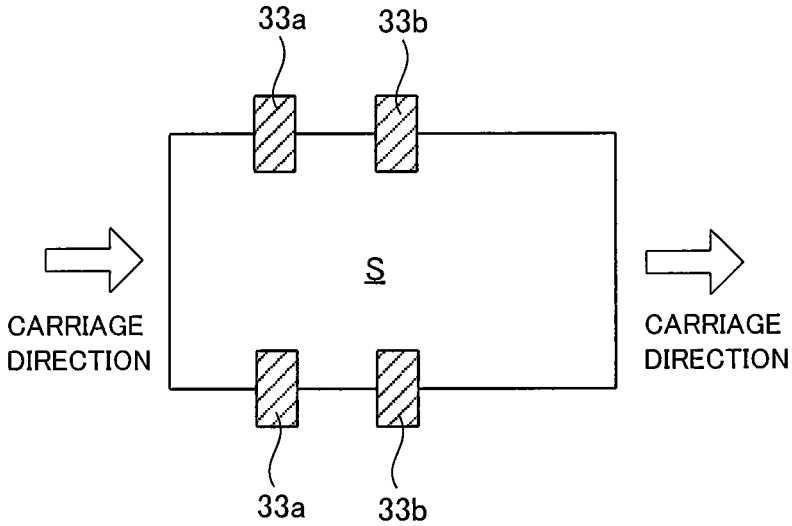
FIG. 4 is a top view of the curl detection unit according to the first embodiment.

The configuration of the curl detection unit 30 will be described by using FIGS. 3 and 4. FIG. 3 is a lateral view of the curl detection unit 30, and FIG. 4 is a top view of the curl detection unit 30.

The sheet passed through the detection unit 14 moves along a first guide member 31. The first guide member 31 forms the carriage path of the sheet. The end of the first guide member 31 includes an incline, and at the end of the first guide member 31, the carriage path of the sheet broadens. A sensor 32 detects whether the sheet passed through the first guide member 31, and outputs the detection result to the controller 100.

The sheet that passed through the first guide member 31 due to rotation of a carriage roller 19*a* moves to a second guide member 34. The carriage path of the second guide member 34 is broader than that of the first guide member 31. When the sheet is curled, the space of the second guide member 34 accepts the curled state of the sheet.

The carriage path of the first guide member 31 is narrower than that of the second guide member 34, therefore, the first guide member 31 presses the curled sheet. The carriage path of the second guide member 34 is broader than that of the first guide member 31, therefore, the second guide member 34 does not press the curled sheet. When the curled sheet is guided to the second guide member 34, the sheet returns to the curled state as its natural state. Specifically, the sheet is bent upwards or downwards.

The second guide member 34 includes an incline 34*a*. The incline 34*a* narrows the carriage path toward a carriage roller 19*b*. The sheet contacting the incline 34*a* moves along the incline 34*a*, and is guided to the carriage roller 19*b* accordingly.

Sensors 33*a* and 33*b* are disposed in the upper portion of the second guide member 34. Sensors 33*a* and 33*b* are provided side by side in the sheet carriage direction. The sensors 33*a* and 33*b* detect whether the sheet passed through, in the range of a predetermined distance from the sensors 33*a* and 33*b*. The detection result of the sensors 33*a* and 33*b* is output to the controller 100.

Detection ranges W1 and W2 of the sensors 33*a* and 33*b* are the same as each other. The sensor 33*b* is more distant from the carriage path (a reference line L) of the sheet compared to the sensor 33*a*. Accordingly, the detection ranges W1 and W2 of the sensors 33*a* and 33*b* are misaligned in a direction orthogonal to the carriage path of the sheet. The detection ranges W1 and W2 include a range in which the detection ranges overlap with each other in the sheet carriage direction.

The detection range W1 of the sensor 33*a* is distant upwardly from the reference line L of the carriage path by a distance W5. The distance W5 is set to prevent a sheet that is not curled from being detected. A specific value of the distance W5 can be appropriately set.

As shown in FIG. 4, the sensors 33*a* and 33*b* are disposed along the edge of a sheet S extending in the carriage direction. The two sensors 33*a* and the two sensors 33*b* are disposed in the upper portion of the second guide member 34. The edge of the sheet S curls easily. Therefore, disposing the sensors 33*a* and 33*b* in positions corresponding to the edge of the sheet S extending in the carriage direction makes it easier to detect curling of the sheet S.

Sensors 33*c* and 33*d* are disposed in the lower portion of the second guide member 34. The sensors 33*c* and 33*d* detect whether the sheet passes, in the range of a predetermined distance from the sensors 33*c* and 33*d*. The detection result of the sensors 33*c* and 33*d* is input to the controller 100.

The detection ranges W3 and W4 of the sensors 33*c* and 33*d* are the same as each other and as the detection ranges W1 and W2. In the embodiment, as the sensors 33*a* to 33*d*, sensors having the same detection characteristic are used.

The sensor 33*d* is more distant from the carriage path (a reference line L) of the sheet compared to the sensor 33*c*. Accordingly, the detection ranges W3 and W4 of the sensors 33*c* and 33*d* are misaligned in the direction orthogonal to the carriage path of the sheet. The detection range W3 of the sensor 33*c* is distant in the downwards direction from the reference line L of the carriage path by the distance W5.

The sensors 33*c* and 33*d* are disposed in the same manner as the sensors 33*a* and 33*b* shown in FIG. 4. That is, the two sensors 33*c* and the two sensors 33*d* are disposed in positions corresponding to the edge of the sheet S extending in the carriage direction.

In the embodiment, the sensors 33*a* and 33*c* are symmetrically disposed while interposing the carriage path therebetween. However, the sensors 33*a* and 33*c* may be misaligned in the sheet carriage direction. In the embodiment, the sensors 33*b* and 33*d* are symmetrically disposed while interposing the carriage path therebetween. However, the sensors 33*b* and 33*d* may be misaligned in the sheet carriage direction.

FIG. 5 shows the correspondence relationship between the outputs of the sensors 33*a* to 33*d* and the determination results of the state of the curl of the controller 100.

When all the sensors 33*a* to 33*d* are turned "OFF", the controller 100 determines that the sheet is not curled. When each of the sensors 33*a* to 33*d* does not detect the sheet, the output signal of each of the sensors 33*a* to 33*d* is turned "OFF". In the embodiment, when the sheet is curled by a curl amount larger than the distance W5, the curled state of the sheet is detected.

When only the sensor 33*a* is turned "ON", the controller 100 determines that the sheet is curled upwards and that the curl amount of the sheet falls within a first range. When the sheet is curled slightly upwards, a portion of the sheet enters the detection range W1 of the sensor 33*a*. The sheet moves out of the detection range w2 of the sensor 33*b*.

When the sensors 33*a* and 33*b* are turned "ON", the controller 100 determines that the sheet is curled upwards and that the curl amount of the sheet falls within a second range. The second range is a range having a larger curl amount than that of the first range. When the sheet is curled considerably upwards, a portion of the sheet enters the detection range W1 of the sensor 33*a* and the detection range W2 of the sensor 33*b*.

When only the sensor 33*c* is turned "ON", the controller 100 determines that the sheet is curled downwards and that the curl amount of the sheet falls within the first range. When the sheet is curled slightly downwards, a portion of the sheet enters the detection range W3 of the sensor 33*c*. The sheet moves out of the detection range W4 of the sensor 33*d*

When the sensors 33*c* and 33*d* are turned "ON", the controller 100 determines that the sheet is curled downwards and that the curl amount of the sheet falls within the second range. The second range is a range having a larger curl amount than that of the first range. When the sheet is curled considerably downwards, a portion of the sheet enters the detection range W3 of the sensor 33*c* and the detection range W4 of the sensor 33*d*.

The controller 100 can determine to which of the collection box 21 and the heat rollers 16 the sheet will be carried, according to the curled state of the sheet. For example, when the curl amount of the sheet falls within the second range, the sheet can be carried to the collection box 21. An excessively curled sheet is carried not to the heat rollers 16 but to the collection box 21. In this manner, it is possible to prevent paper jams from occurring on the carriage path passing through the heat rollers 16.

In the embodiment, the sensor 33*a* is disposed at the upstream of the carriage path of the sensor 33*b*. However, the sensor 33*a* can be disposed at the downstream of the carriage path of the sensor 33*b*. The sensor 33*c* is disposed at the upstream of the carriage path of the sensor 33*d*. However, the sensor 33*c* can also be disposed at the downstream of the carriage path of the sensor 33*d*. The positional relationship of the sensors 33*a* and 33*b* in the sheet carriage direction and the positional relationship of the sensors 33*c* and 33*d* in the sheet carriage direction can be appropriately set.

In the embodiment, the sensors 33*a* and 33*b* (or the sensors 33*c* and 33*d*) are provided at positions where the distance from the reference line L of the carriage path is different. However, the sensors can also be provided at positions where the distance from the reference line L is equal. When the sensors 33*a* and 33*b* (or the sensors 33*c* and 33*d*) are provided at positions where the distance from the reference line L is equal, the detection range of the sensors 33*a* and 33*b* (or the sensors 33*c* and 33*d*) may be varied. Specifically, the detection range of the sensor 33*a* can be made to be broader than that of the sensor 33*b*.

In the embodiment, the two detection ranges W1 and W2 (or the detection ranges W3 and W4) are provided at one side of the carriage path. However, it is also possible to provide one or three or more of the detection ranges. In the embodiment, the detection ranges W1 to W4 are provided at both sides of the carriage path. However, it is also possible to provide the detection ranges at only one side of the carriage path.

According to the embodiment, a space in which the curled state of the sheet is restored is provided in the carriage path of the sheet, and the curled state of the sheet can be detected by using the sensors 33*a* to 33*d*. Misaligning the positions of the sensors 33*a* to 33*d* makes it possible to distinguish the curl amount of the sheet.

In the embodiment, before the sheet is guided to the heat rollers 16, the curl detection unit 30 detects the curled state of the sheet. However, as shown in FIG. 6, it is possible for the curl detection unit 30 to detect the curled state of the sheet after the sheet passed through the heat rollers 16.

When the sheet passes through the heat rollers 16, there is a concern that the sheet may curl. By disposing the curl detection unit 30 at the downstream of the carriage path of the heat rollers 16, it is possible to determine whether the sheet curled due to the heat rollers 16.

It is also possible to dispose the curl detection unit 30 at the upstream and the downstream of the carriage path from the heat rollers 16.

Figure 6:
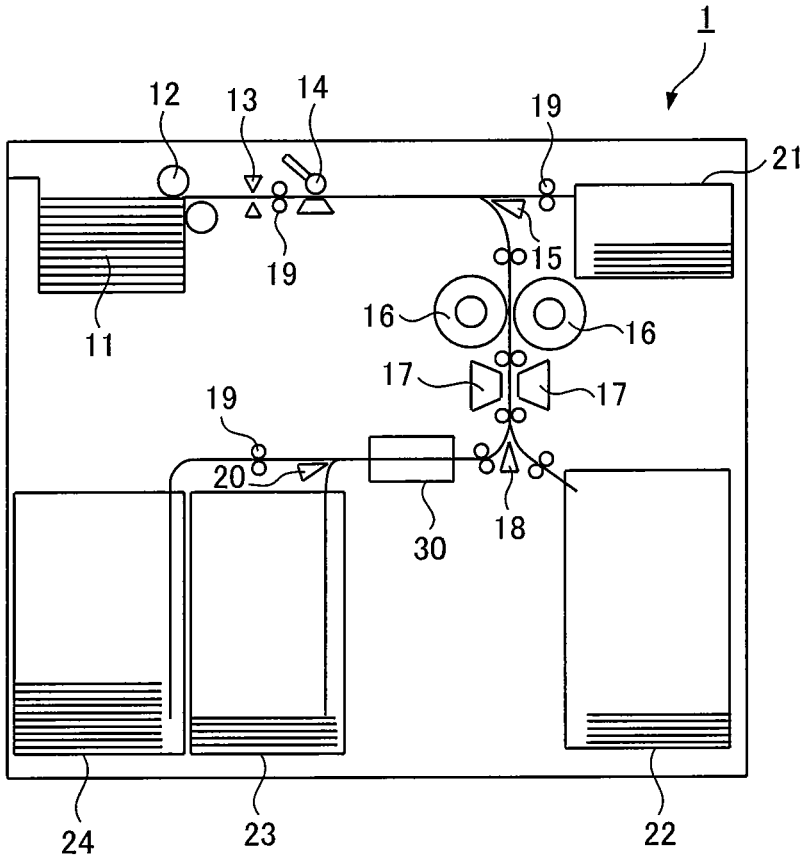
FIG. 6 is a view showing an internal configuration of an image erasing device as an example of modification of the first embodiment.

In the configuration shown in FIG. 6, by using the two boxes 23 and 24, it is possible to sort the sheets into curled sheets and sheets that are not curled. Sheets that are not curled are reusable. Because of the possibility of a jam occurring in an image forming apparatus, it is not easy to reuse a curled sheet.

The flapper 20 is disposed at the downstream of the carriage path of the curl detection unit 30, and switches the carriage path guiding the sheet to the box 23 to the carriage path guiding the sheet to the box 24. Based on the detection result of the curl detection unit 30, the controller 100 controls the driving of the flapper 20

Second Embodiment

Figure 7:
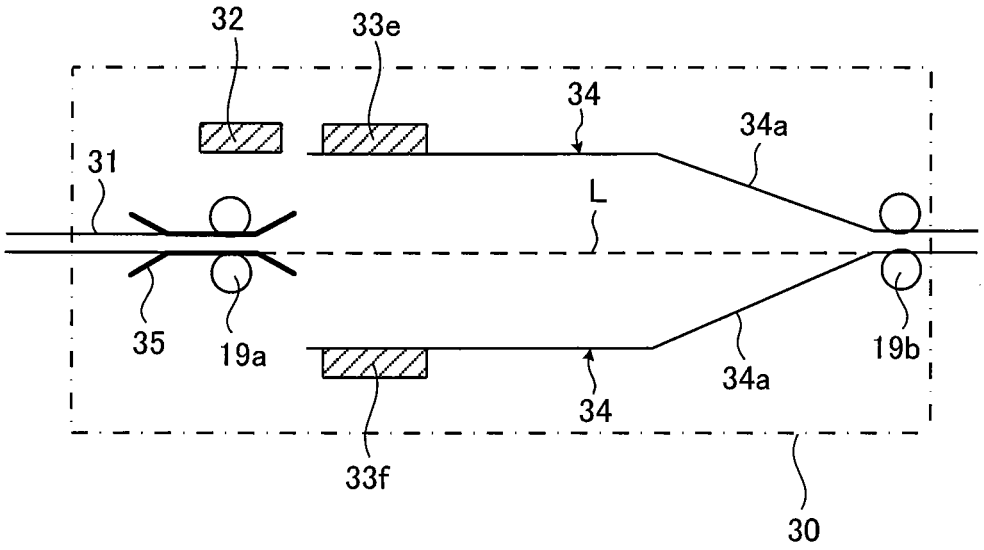
FIG. 7 is a lateral view of a curl detection unit according to a second embodiment.

FIG. 7 is a lateral view of the curl detection unit as the embodiment. The curl detection unit 30 of the embodiment includes a third guide member 35. Inside the second guide member 34, the third guide member 35 moves along the carriage path of the sheet.

In the embodiment, the curl detection unit 30 is provided in the image erasing device 1. The position where the curl detection unit 30 is disposed is the same as the position in the case described in the first embodiment.

Figure 8:
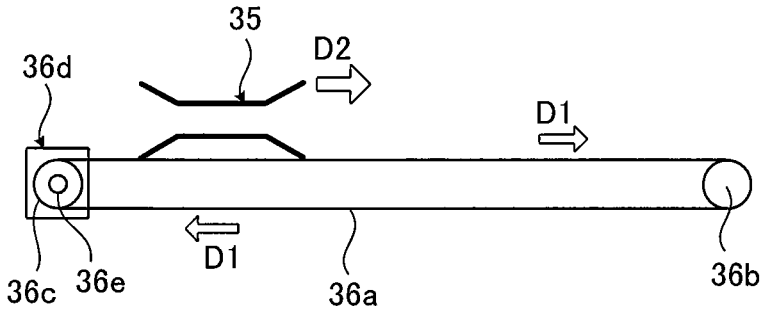
FIG. 8 is a lateral view showing a driving mechanism of a third guide member according to the second embodiment.

As shown in FIG. 8, the third guide member 35 is fixed to a belt 36*a*. The belt 36*a* is hung over two pulleys 36*b* and 36*c*. The pulley 36*c* is connected to a rotation axis 36*e* of a motor 36*d*. The belt 36*a*, the pulleys 36*b* and 36*c*, and the motor 36*d* is a driving mechanism driving the third guide member 35.

The torque of the motor 36*d* is transmitted to the belt 36*a*, and thereby the belt 36*a* can move in the direction of an arrow D1. When the belt 36*a* moves in the direction of the arrow D1, the third guide member 35 fixed to the belt 36*a* moves in the direction of an arrow D2.

After the third guide member 35 moves in the direction of the arrow D2, the belt 36*a* moves in the reverse direction of the arrow D1, whereby the third guide member 35 returns to its original position.

The third guide member 35 is disposed alongside the first guide member 31. The form of the third guide member 35 can be set appropriately as long as the third guide member 35 can guide the sheet in one-way while contacting the sheet.

A sensor 32 is used to detect whether the sheet passed through the first guide member 31. When the leading end of the sheet reaches the detection position of the sensor 32, the output of the sensor 32 is switched to "ON" from "OFF". While the sheet is passing through the detection position of the sensor 32, the output of the sensor 32 remains "ON". When the rear end of the sheet reaches the detection position of the sensor 32, the output of the sensor 32 is switched to "OFF" from "ON".

The leading end of the sheet is the end of the sheet positioned at the upstream of the carriage path. The rear end of the sheet is the end of the sheet positioned at the downstream of the carriage path.

Figure 9:
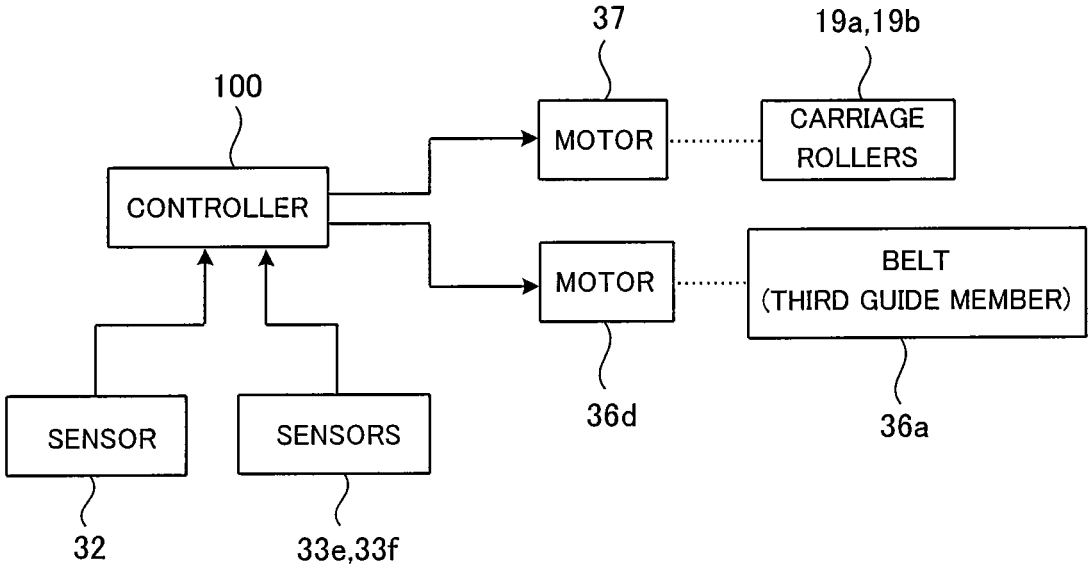
FIG. 9 is a view showing a partial circuit configuration of the image erasing device as the second embodiment.

As shown in FIG. 9, the controller 100 controls the driving of the motor 36*d*, based on the output of the sensor 32. The controller 100 controls the driving of a motor 37. The driving force of the motor is transmitted to the carriage rollers 19*a* and 19*b*, and by the rotation of the carriage rollers 19*a* and 19*b*, the sheet is carried.

The second guide member 34 includes sensors 33*e* and 33*f* in the position interposing the carriage path of the sheet therebetween. The sensors 33*e* and 33*f* are used to detect the curled state of the sheet. The sensor 33*e* is disposed over the carriage path, and the sensor 33*f* is disposed below the carriage path.

The detection range of the sensors 33*e* and 33*f* are distant from the reference line L of the carriage path. When the sheet is curled, the curled portion enters the detection range of the sensors 33*e* and 33*f*.

When a portion of the sheet enters the detection range of the sensors 33*e* and 33*f*, the controller 100 determines that the sheet is curled, based on the output signals of the sensors 33*e* and 33*f*. The sensor 33*e* disposed over the carriage path is used to detect a state where the sheet is curled upwards. The sensor 33*f* disposed below the carriage path is used to detect a state where the sheet is curled downwards.

Figure 10:
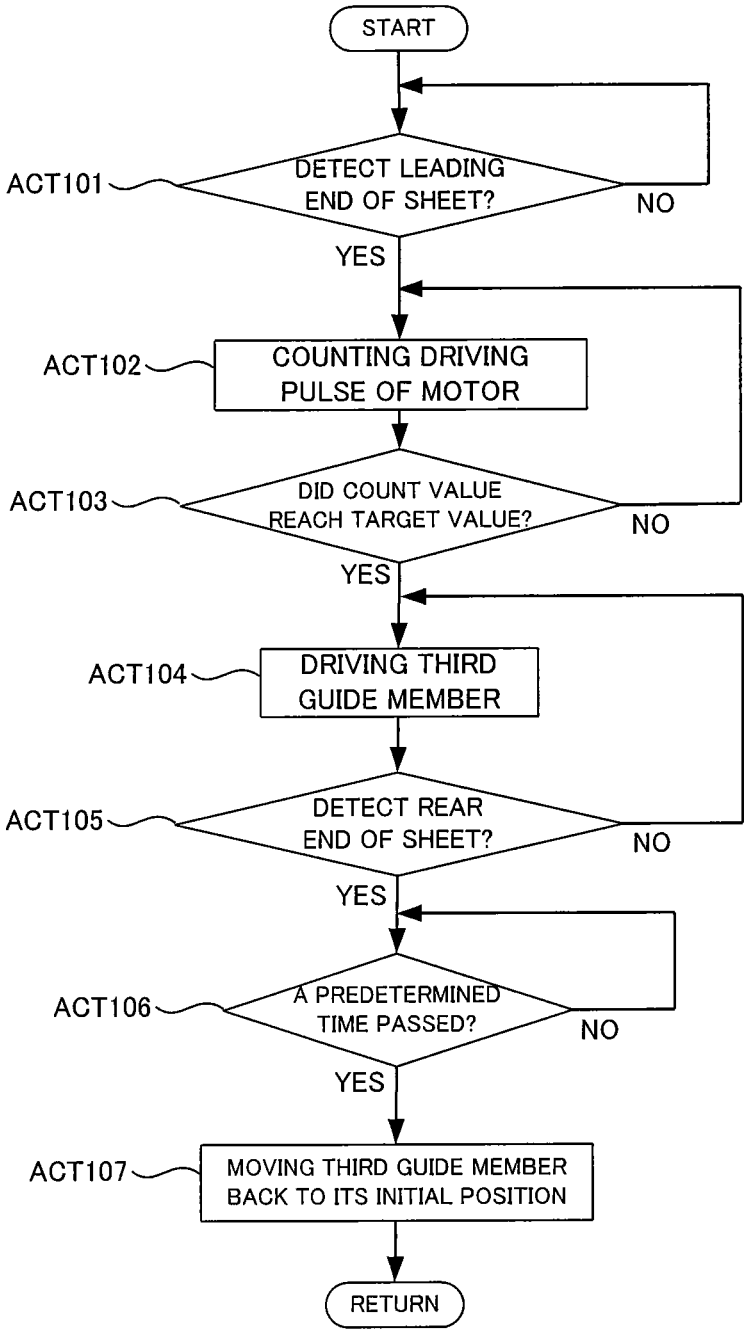
FIG. 10 is a flowchart showing an operation of the curl detection unit according to the second embodiment.

FIG. 10 is a flowchart describing the operation of the curl detection unit 30. The process shown in FIG. 10 is performed by the controller 100.

Based on the output of the sensor 32, the controller 100 determines whether the leading end of the sheet was detected (ACT 101). When the leading end of the sheet was detected (ACT 101, YES), the controller 100 counts the driving pulses of the motor 37 (ACT 102).

The controller 100 determines whether the count value of the driving pulse reached a target value (ACT 103). The target value corresponds to the driving amount of the motor 37 in a period of time for which the leading end of the sheet passes the detection position of the sensor 32 and reaches the detection range of the sensors 33*e* and 33*f*.

When the count value of the driving pulse reaches the target value (ACT 103, YES), the controller 100 moves the third guide member 35 by driving the motor 36*d* (ACT 104). The third guide member 35 stays at the initial position shown in FIG. 7 and moves by receiving the driving force of the motor 36*d*.

Figure 11:
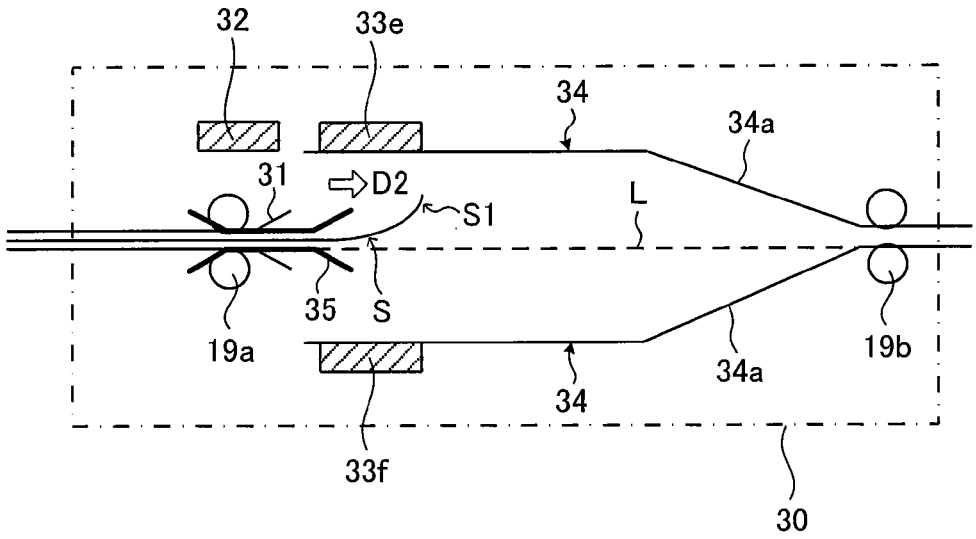
FIG. 11 is a view describing an operation of the curl detection unit according to the second embodiment.
Figure 12:
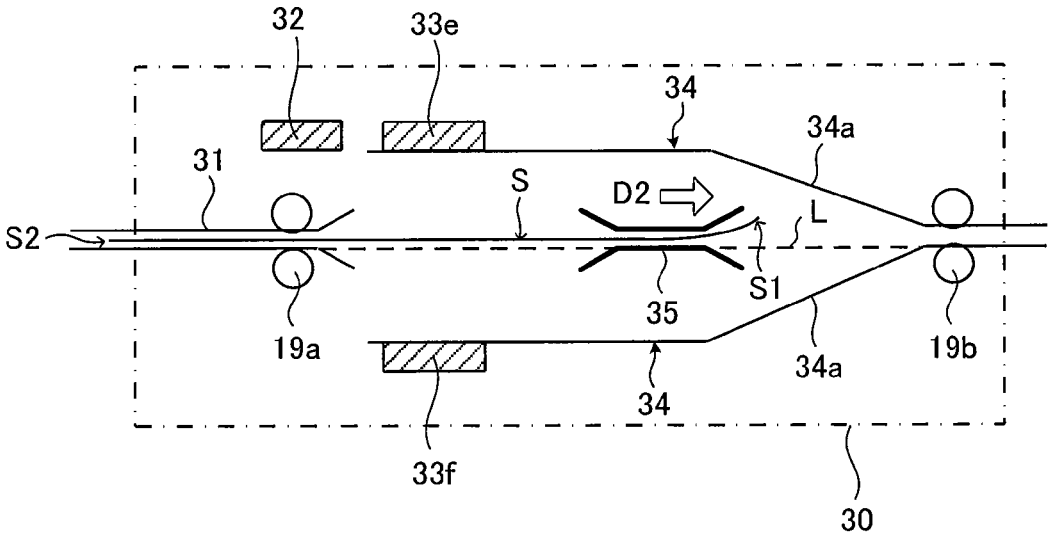
FIG. 12 is a view describing an operation of the curl detection unit according to the second embodiment.

FIG. 11 shows a state where the third guide member 35 starts to move. In FIG. 11, a leading end S1 of the sheet S curls upwardly. Since the second guide member 34 has the broader carriage path compared to the first guide member 31, when the curled sheet S moves to the second guide member 34, the curled state of the sheet S is restored to its original state. In FIG. 11, the leading end S1 of the sheet S is passing through the detection range of the sensor 33*e*. The third guide member 35 moves in the direction of the arrow D2 by receiving the driving force of the motor 36*d*. The carriage roller 19*a* rotates by receiving the driving force of the motor 37, and the sheet S moves in the direction of the arrow D2 by receiving the torque of the carriage roller 19*a*. As shown in FIG. 12, in response to the movement of the sheet S in the direction of the arrow D2, the third guide member 35 also moves in the direction of the arrow D2.

The movement speed of the third guide member 35 is higher than the carriage speed of the sheet S. Before the leading end S1 of the sheet S reaches the incline 34*a* of the second guide member 34, the third guide member 35 reaches the leading end S1 of the sheet S.

Since the third guide member 35 reaches the leading S1 of the sheet S, it is possible to suppress the curling of the sheet S. Both ends of the third guide member 35 in the sheet carriage direction have inclines, and at the both ends of the third guide member 35, the carriage path is broadened. The curled sheet S is easily deformed along the third guide member 35.

Based on the output of the sensor 32, the controller 100 determines whether a rear end S2 of the sheet S passed through the detection position of the sensor 32 (ACT 105).

Figure 13:
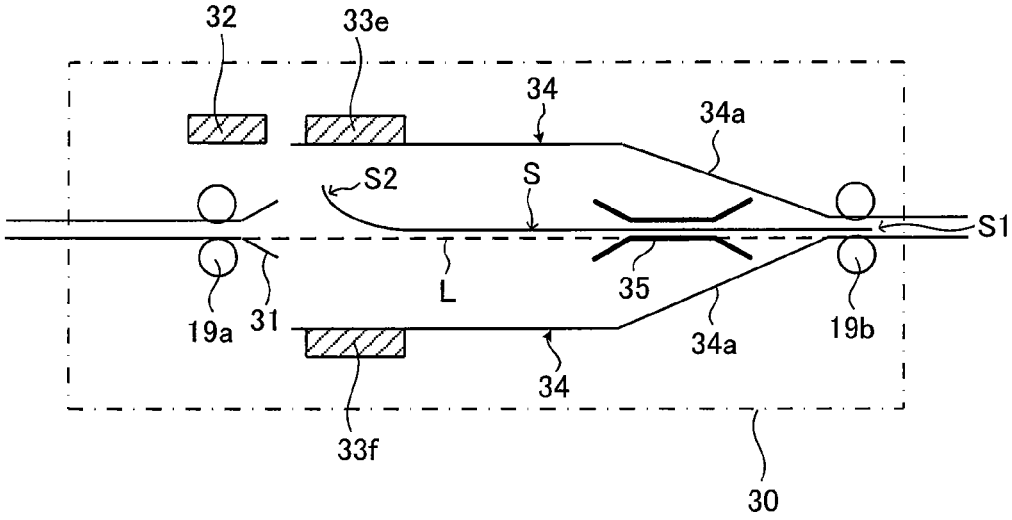
FIG. 13 is a view describing an operation of the curl detection unit according to the second embodiment.

After detecting the rear end S2 of the sheet S based on the output of the sensor 32, the controller 100 waits for a predetermined time to pass by operating a timer. The predetermined time refers to a period of time for which the rear end S2 of the sheet S passes through the detection position of the sensor 32 and then passes through the detection range of the sensors 33*e* and 33*f*. In FIG. 13, the rear end S2 of the sheet S is curled upwards, and the sensor 33*e* is detecting the rear end S2 of the sheet S.

As shown in FIG. 13, the third guide member 35 is distant from the first guide member 31; therefore, when the rear end S2 of the sheet S is curled, as the rear end S2 of the sheet S becomes distant from the first guide member 31, the curled state of the sheet S is restored to its original state. The sensors 33*e* and 33*f* can detect the curled state of the rear end S2 of the sheet S. When the rear end S2 of the sheet S passes through the carriage roller 19*a*, the leading end S1 of the sheet S is contacting the carriage roller 19*b*.

When the predetermined time passed (ACT 106, YES), the controller 100 moves the third guide member 35 back to its initial position by driving the motor 36*d* (ACT 107). The rear end of the third guide member 35 has an incline, and the carriage path is broadened at the rear end of the third guide member 35. Therefore, even though the rear end S2 of the sheet S is curled, the sheet S can smoothly move along the third guide member 35.

According to the embodiment, since the carriage path of the second guide member 34 is broader than that of the first guide member 31, when the sheet S is curled, the curled state of the sheet S can be restored to its original state in the carriage path of the second guide member 34. In the state where the curled state of the sheet S is restored to its original state, it is possible to detect the curled state of the sheet S by using the sensors 33*e* and 33*f*.

By using the third guide member 35, it is possible to smoothly guide the sheet S to the carriage roller 19*b* without making the leading end S1 of the sheet S bump into the incline 34*a* of the second guide member 34 even though the leading end S1 of the sheet S is curled. When the curled leading end S1 bumps into the incline 34*a* of the second guide member 34, the sheet S is folded and bent in some cases.

In the embodiment, each of the sensors 33*e* and 33*f* is disposed at positions interposing the carriage path therebetween. However, as shown in the first embodiment, it is also possible to dispose two or more of the sensors 33*a* to 33*d* at positions interposing the carriage path therebetween. If two or more of the sensors are disposed at one side of the carriage path, it is possible to distinguish the curl amount of the sheet.

Third Embodiment

Figure 14:
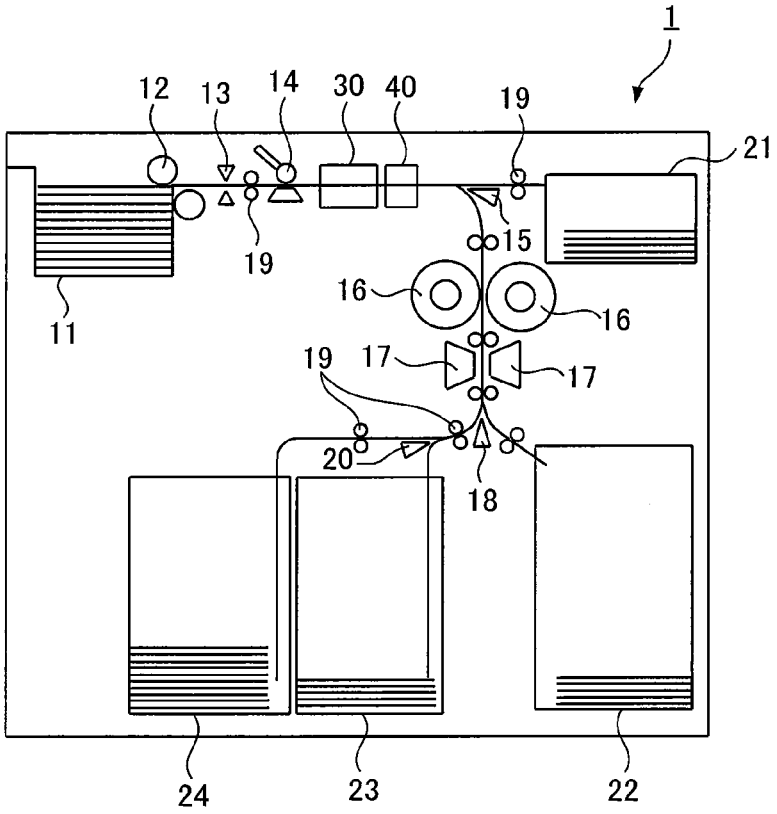
FIG. 14 is a view showing an internal configuration of an image erasing device as a third embodiment.

FIG. 14 shows the internal configuration of the image erasing device 1 as the embodiment.

The detection unit 14 includes an arm displacing in the vertical direction when a sheet passes, a permanent magnet provided to the arm, and a magnetic sensor detecting the magnetism of the permanent magnet. The detection unit 14 (magnetic sensor) outputs electric signals according to the thickness of the sheet. If the detection unit 14 is used, it is possible to detect a state where a binding member is attached to the sheet, or to detect a portion folded and bent of the sheet. Examples of the binding member include a clip and a staple.

The sheet passed through the detection unit 14 is guided to the curl detection unit 30. The curl detection unit 30 detects the curled state of the sheet. As the curl detection unit 30, it is possible to use the configuration described in the first and second embodiments.

The sheet passed through the curl detection unit 30 is guided to a detection unit 40. Although the detection unit 40 performs the same detection as the detection unit 14, the detection accuracy of the detection unit 40 is higher compared to the detection unit 14. The detection unit 40 can detect the state of the sheet that the detection unit 14 cannot detect.

Specifically, the detection unit 40 can detect a state where a sheet-like substance is attached to the surface of the sheet or a state where a layer of a foreign substance such as an adhesive is formed on the surface of the sheet. Examples of the sheet-like substance include a post-it and an adhesive tape.

When determining that the foreign substance is attached to the sheet based on the output of the detection units 14 and 40, the controller 100 moves the sheet to the collection box 21 by driving the flapper 15. When determining that there is no foreign substance attached to the sheet based on the output of the detection units 14 and 40, the controller 100 moves the sheet to the heat rollers 16 by driving the flapper 15.

According to the embodiment, the sheet having a foreign substance attached thereto is not guided to the heat rollers 16 but moved to the collection box 21. In this manner, it is possible to prevent the heat rollers 16 from being damaged due to the foreign substance and to prevent the image from not being erased due the foreign substance. Using the two detection units 14 and 40 having different detection accuracy makes it possible to perform detection suitable for the detection accuracy of each of the detection units 14 and 40.

In the embodiment, the detection unit 40 is disposed to the downstream of the carriage path of the curl detection unit 30. However, it is also possible to dispose the detection unit 40 between the detection unit 14 and the curl detection unit 30. The detection operation of the detection unit 40 may be performed after the detection operation of the detection unit 14 is completed.

In the above described embodiment, the curl detection unit 30 is provided in the image erasing device 1, but the curl detection unit 30 can be provided in an image forming system.

Specifically, in an image forming system including an image forming apparatus and a post-processing device, the detection operation of the curl detection unit 30 can be performed when the sheet is carried to the post-processing device from the image forming apparatus. The curl detection unit 30 can be provided in the image forming apparatus or the post-processing device. The post-processing device can perform stapling or folding with respect to the sheet from the image forming apparatus, for example.

While certain embodiments have been described, these embodiments have been presented by way of example only, and are not intended to limit the scope of invention. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image erasing device comprising:

a heater erasing a color of a developer attached to a sheet by heating the sheet;

a first guide member carrying the sheet;

a second guide member including a carriage path that is broader than a carriage path of the first guide member and being arranged at a downstream of the carriage path with respect to the heater;

a sensor detecting a curling state of the sheet and being arranged on the carriage path of the second guide member.

2. The device according to claim 1, further comprising a scanner reading an image of the sheet and being arranged at an upstream of the carriage path with respect to the second guide member.

3. The device according to claim 2, further comprising:

a first containing section containing the sheet and being arranged at an downstream of the carriage path with respect to the sensor:

a second containing section containing the sheet and being arranged at an downstream of the carriage path with respect to the sensor.

4. The device according to claim 3, further comprising:

a first flapper being arranged at a downstream of the carriage path with respect to the sensor and at an upstream of the carriage path with respect to the first and second containing sections, and switching between the carriage path to the first containing section and the carriage path to the second containing section; and a controller controlling drive of the first flapper based on output of the sensor.

5. The device according to claim 4, wherein the controller controls the drive of the first flapper to convey the non-curled sheet to the first containing section and to convey the curled sheet to the second containing section.

6. The device according to claim 4, further comprising:

a third containing section containing the sheet and being arranged at a downstream of the carriage path with respect to the scanner; and a second flapper being arranged at a downstream of the carriage path with respect to the scanner and at an upstream of the carriage path with respect to the sensor, and switching between the carriage path to the third containing section and the carriage path to the sensor, wherein the controller controls drive of the second flapper based on output of the scanner.

7. The device according to claim 1, wherein the second guide member narrows the carriage path toward the sheet carriage direction.

8. The device according to claim 1, wherein a plurality of the sensors are respectively disposed at positions interposing the carriage path of the second guide member therebetween.

9. The device according to claim 1 further comprising:

a third guide member including a carriage path narrower than the carriage path of the second guide member and moving inside the second guide member; and a driving mechanism driving the third guide member.

10. The device according to claim 9, wherein the movement speed of the third guide member is higher than the movement speed of the sheet moving in the second guide member.

11. The device according to claim 1, wherein a plurality of the sensors is disposed at positions of a distance different from the carriage path, on at least one of the positions interposing the carriage path of the second guide member therebetween.

12. The device according to claim 11, wherein a plurality of the sensors lines up along the sheet carriage direction.

* * * * *